US005233128A

United States Patent [19]

Lai

[11] Patent Number: 5,233,128

[45] Date of Patent: Aug. 3, 1993

[54] BARREL-CLEANING BULLET

[76] Inventor: David Lai, 2121 Evans Ave., San Francisco, Calif. 94124

[21] Appl. No.: 923,406

[22] Filed: Jul. 31, 1992

[51] Int. Cl.[5] ..... F42B 14/04

[52] U.S. Cl. ..... 102/511; 102/529

[58] Field of Search ..... 102/529, 511, 512, 442, 102/501

[56] References Cited

U.S. PATENT DOCUMENTS

| | | | |
|---|---|---|---|
| 721,050 | 2/1903 | Kersey | 102/529 |
| 802,301 | 10/1905 | Michele | 102/511 |
| 1,039,774 | 10/1912 | Melander | 102/511 |
| 1,376,316 | 4/1921 | Chilowsky | 102/511 |
| 1,481,930 | 1/1924 | Schneider | 102/511 |
| 1,495,008 | 5/1924 | Feagin | 102/529 |
| 2,011,249 | 8/1935 | Larson | 102/511 |
| 2,442,155 | 5/1948 | Weese | 102/529 |
| 3,147,708 | 9/1964 | Ferguson | 102/529 |
| 3,208,387 | 9/1965 | Giles | 102/511 |
| 3,820,465 | 6/1974 | Delphia | 102/512 |
| 4,204,474 | 5/1980 | Mizelle | 102/529 |
| 4,513,668 | 4/1985 | Fuller | 102/511 |
| 4,610,205 | 9/1986 | Bentley | 102/501 |
| 4,858,534 | 8/1989 | Wallace | 102/511 |

*Primary Examiner*—David H. Brown
*Attorney, Agent, or Firm*—Townsend and Townsend Khourie and Crew

[57] ABSTRACT

A barrel-cleaning bullet contains a charge of cleaning fluid and an array of cleaning elements that extend about the exterior surface of the bullet. Upon firing of the bullet, a piston, slidably positioned in the cavity filled by the fluid, forces the fluid through at least one discharge port formed in the head of the bullet. The fluid is, thus, distributed along the walls of the gun barrel to treat accumulated deposits. As the projectile accelerates down the barrel, the cleaning elements contact the deposits to clean the barrel bore.

20 Claims, 2 Drawing Sheets

BARREL-CLEANING BULLET

BACKGROUND OF THE INVENTION

The invention relates, generally, to a device for cleaning a gun barrel or the like, and more particularly to a projectile that upon firing, cleans the inner walls of the barrel as it travels through the barrel bore.

Projectiles constructed to clean the barrel of a gun typically have included scrapers and cleaning elements. Generally, the scraper is arranged on the projectile in advance of the cleaning element for the purpose of loosening the burnt powder or rust from the wall of the bore, so that this dirt or foreign material can be carried out of the barrel by the cleaning element when the projectile is fired. However, it has been found that these scrapers often do not adequately loosen the gunpowder residue and rust, which then renders the cleaning element essentially ineffective.

SUMMARY OF THE INVENTION

The present invention is directed to a barrel-cleaning bullet that avoids the problems and disadvantages of the prior art. The invention accomplishes this goal by providing a projectile comprising a body portion having a cavity formed therein and a cleaning fluid disposed in the cavity. A piston is slidably mounted in the cavity and positioned adjacent to the rearward end of the projectile such that the forward face of the piston faces the cleaning fluid in the cavity. At least one discharge port is provided in the vicinity of the forward end of the body portion to discharge cleaning fluid forwardly of the bullet. Firing of the projectile causes the piston to accelerate toward the fluid in the cavity and force the fluid through the discharge port and into the barrel for treating accumulated gun powder deposits and the like for removal. As the projectile travels down the barrel bore, mechanical cleaning elements provided about the exterior surface of the projectile, between the discharge port and the rearward end of the projectile, scrape the treated deposits and wipe the barrel clean.

It is important that the discharge port is in the vicinity of the forward end of the body portion and oriented to direct the cleaning fluid in front of the forward end of the bullet. This construction ensures that the cleaning fluid reaches the barrel walls before the mechanical cleaning elements as the bullet accelerates along the barrel bore. It has been found that when discharge ports are placed along the side of the body portion of the projectile, the bullet exits the barrel before the fluid reaches the barrel wall. It is believed that this is due to the bullet speed being much greater than the fluid velocity as it is discharged from the ports. However, with the discharge port being generally aligned along the central axis of the projectile, substantially all of the cleaning fluid reaches the barrel walls before the bullet exits the barrel bore. In this manner, the cleaning fluid chemically treats and loosens the accumulated gun powder deposits in the barrel before the mechanical cleaning elements contact the deposits.

In a first embodiment, a single discharge port is provided. The longitudinal axes of the discharge port and body portion are angularly offset from one another by about 5 to 15 degrees. This construction ensures that essentially all of the cleaning fluid reaches the barrel walls. Such is not the case when the cleaning fluid is merely directed down the central axis of the barrel. The offset discharge port also will cause the fluid dispensed from the projectile to flow in a spiral pattern to enhance wall coverage. In a further embodiment, multiple discharge ports are formed in the forward end of the bullet. These ports are angled such that fluid dispensed therefrom forms a spiral pattern along the inner wall surfaces of the barrel bore. In this way, a relatively uniform distribution of the fluid is applied to the barrel walls. Increased wall coverage also is achieved. Additionally, these ports are equidistantly spaced from one another to balance the reaction forces and minimize barrel vibration.

Finally, the barrel-cleaning bullet preferably is configured and sized as a conventional bullet so that the cleaning bullet cartridge can fit in a bullet chain for an automatic firearm.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENT

Figure 1:
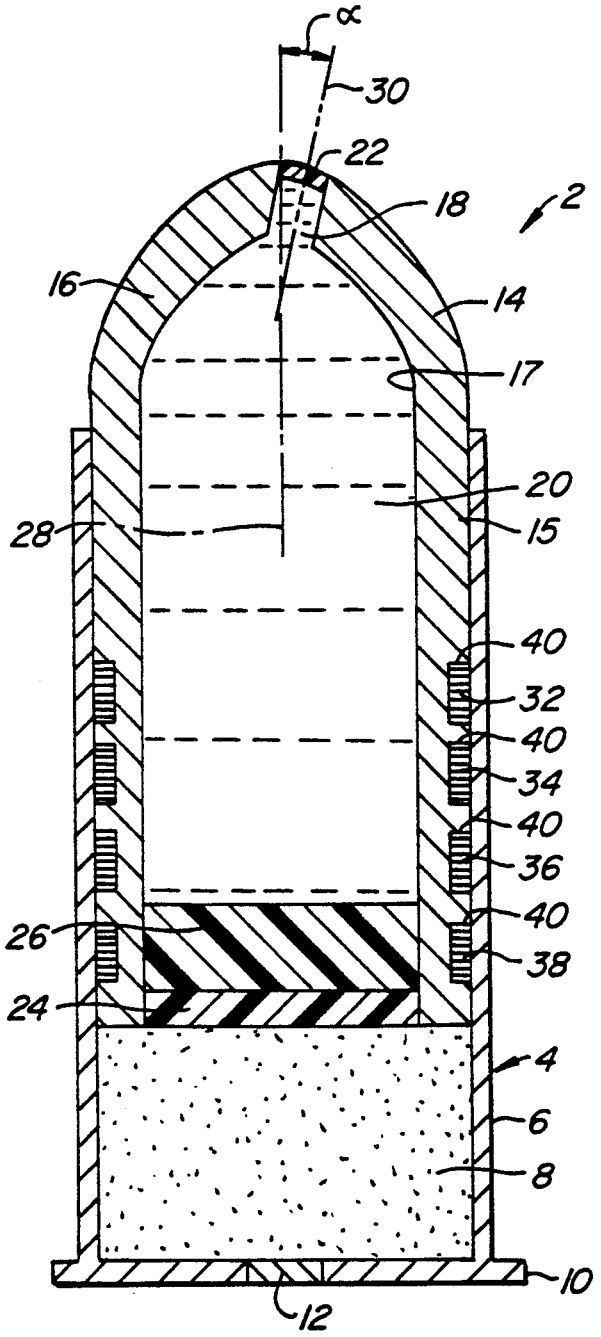
FIG. 1 is a longitudinal sectional view of a barrel-cleaning bullet constructed in accordance with a first embodiment of the present invention.

Referring to FIG. 1, barrel-cleaning bullet 2 is illustrated seated in a shell 4 which includes shell casing 6, which contains a charge of propellant 8, rim 10, and primer cap 12. Barrel-cleaning bullet 2 includes a body portion 14 having a generally cylindrical wall 15 and convex head portion 16, which define cleaning fluid containing cavity or chamber 17. Discharge port 18 extends from cavity 17 to the exterior surface of the bullet to provide a passage for discharging the fluid from cleaning bullet 2.

Chamber 17 is filled with a charge 20 of cleaning fluid which preferably is a mixture of a lubricant and a solvent. For example, a solution comprising silicon, petroleum distillates, butyl cellosolve, and a penetration agent is suitable. One suitable commercially available cleaning solution is Shooter's Choice® manufactured by Ventco, Inc. of Chesterland, Ohio. It is preferred that the solution include a lubricant so that the barrel walls are both cleaned and lubricated. The lubricant acts both to lubricate the frictional contact between the bullet and the gun barrel and to leave behind a coating of low thermal conductivity to reduce heat transfer from the hot propellant gases to the gun barrel. The solution also should have a viscosity suitable for rapid flow through discharge port 18 which preferably has a diameter of about 1 to 5 mm depending on the caliber of the bullet and the length of the barrel.

The forward and rearward portions of chamber 17 are sealed to prevent cleaning solution leakage. Specifically, a wax plug 22 is positioned in the outermost region of discharge port 18, and a wax disc 24 is positioned in the rearmost portion of cavity 17 as illustrated in FIG. 1. These seals are constructed and configured to prevent leakage from either end of the fluid reservoir, but they must be capable of being readily displaced such that the fluid can be dispensed from the cleaning bullet when so desired. It has been found that the wax construction effectively seals the fluid in the bullet and permits essentially unrestrained seal displacement when the cleaning fluid is discharged upon firing of the bullet, as will be discussed in detail below. Rear seal 24 additionally provides a propellant-opposable rear face that transfers force to a piston (discussed below) when gaseous propellant is generated by ignition of propellant charge 8.

Piston 26, which preferably is nylon, is slidably disposed in cavity 17 for axial displacement along the longitudinal or rotational axis 28 of cleaning bullet 2. The rearward face of disc-shaped piston 26 is seated against the forward face of rear seal 24 and retained in that position by the fluid pressure in cavity 17. Seal 24 prevents any fluid from leaking past the parametrial side surfaces of disk 26 and into propellant charge 8.

Mechanical cleaning devices 32, 34, 36 and 38 are positioned about the exterior of projectile 2, in a generally rearward portion and in a plurality of annular recesses 40 that are formed on the surface of the projectile. The first two cleaning elements 32, 34 are positioned closest to the head of the bullet. Each element comprises a ring of bristles, forming a ring-like brush, to loosen and clean burnt powder and rust from the barrel walls. The bristles are relatively soft so that they will not scratch or damage the interior of the barrel and, thus, preferably comprise brass or copper. In addition, brush elements 32, 34 are constructed to perform substantially different functions. Brush element 32, closest to the head of projectile 2, comprises a plurality of coarse bristles, whereas annular brush 34 comprises a plurality of fine bristles. The coarse bristles provide the requisite strength to scrape rust from the barrel, whereas the fine brush ring brushes off the remaining powder. The cleaning devices further include absorbent pads 36, 38, which are seated in the remaining recesses 31, to wipe off any remaining scale and provide the final cleaning of the barrel walls. Suitable wipers include absorbent cotton or felt. Specifically, absorbent pad 36 catches scale, while absorbent pad 38 wipes the barrel walls clean. Referring to FIG. 1, the cleaning devices are axially spaced. It has been found that the exiting bullet is going so fast that the rear portion of a wide cleaning element may be relatively ineffective. The space between cleaning elements enables the leading edge of the adjacent element to provide a fresh grip or bite into the deposits to be removed or wiped from the wall. Additionally, cleaning devices 32, 34, 36 and 38 have diameters slightly larger than the barrel in which they are intended to travel. This provides appropriate contact between the cleaning devices and the barrel walls for cleaning. In FIG. 1, these devices are illustrated as being slightly compressed such that they fit inside shell 4.

Obviously, the configuration of the mechanical cleaning members can be altered without departing from the scope of the present invention. In addition, the sizes and materials used to make up these elements can be selected from a wide variety of sizes and/or materials. Generally, each brush ring 32, 34 preferably has a band width of about $\frac{1}{8}$–$\frac{1}{4}$ inch and each absorbent pad ring 36, 38 preferably has a band width of about 3/16–$\frac{1}{4}$ inch. It is also noted that the distance between each cleaning element 32, 34, 36, and 38 preferably is about $\frac{1}{8}$–$\frac{1}{4}$ inch to ensure that these elements catch and hold scale as the bullet accelerates down the barrel. Merely to exemplify a preferred arrangement of these components for a 30-caliber bullet, the following may be recited. The brush pad width preferably is about $\frac{1}{8}$ of an inch, the absorbent band width is about 3/16 of an inch and the distance between each cleaning element is about $\frac{1}{8}$ inch.

Discharge port 18 is positioned at the head of bullet 2 to ensure that the cleaning solution is applied to the barrel walls before the cleaning devices sweep the walls as the bullet advances down the barrel bore. Specifically, when the propellant charge 8 is detonated, piston 26 (along with seal 24) moves to the head of the bullet, while dispensing the cleaning fluid therefrom. The bullet follows the dispensed fluid down the barrel, while cleaning the barrel walls with cleaning elements 32, 34, 36, and 38 as it travels.

The orientation of discharge port 18 also constitutes an important feature of the invention. The center axis 30 of discharge port 18 is slightly offset from the longitudinal axis 28 of the cleaning bullet as designated by angle $\alpha$. This angle prevents substantial loss of discharged cleaning fluid from the bore, unlike a discharge port having a center axis aligned with longitudinal axis 28 exit. In addition, this configuration will cause the fluid dispensed from the projectile to follow a spiral path along the inner wall surfaces of the barrel. This enhances wall coverage.

The angle at which the discharge port center axis is offset from the bullet's longitudinal axis ($\alpha$) preferably is about 5 to 15 degrees. It has been found that values below this range can result in an undesirable loss of cleaning fluid from the barrel bore, while values above this range can result in the bullet's passing a portion of the barrel wall before the cleaning fluid reaches that portion, due to the extremely high velocity of the bullet. For example, when the discharge port is oriented at an angle greater than 15 degrees from the rotational axis of the bullet, the discharged fluid falls back upon the outer surface of the bullet and accumulates along the cleaning mechanisms discussed below. Only about 20% of the cleaning fluid that accumulates on the cleaning mechanisms is then transferred to the wall. Of that 20%, very little is effective in treating the gun powder deposits in time for further mechanical cleaning by the cleaning mechanisms provided on the exterior of the bullet.

In operation, a firing pin is impacted on primer cap 12 which detonates the propellant charge 8 in the shell. Gaseous propellant is generated by this ignition of the propellant charge which accelerates the piston 26 against the fluid in cavity 17 such that seal 22 is displaced and the cleaning fluid discharged from discharge port 18. The cleaning fluid is discharged in the barrel for actively treating the accumulated deposits therein before the cleaning elements 32, 34, 36 and 38 sequentially remove the treated and loosened accumulated deposits from the barrel wall, as discussed above.

Figure 2:
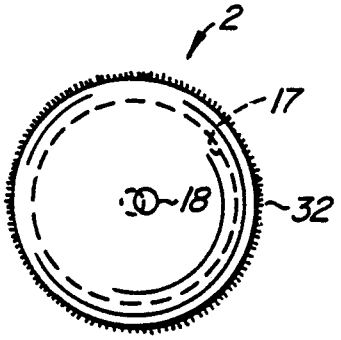
FIG. 2 is a top plan view of the bullet illustrated in FIG. 1.
Figure 5:
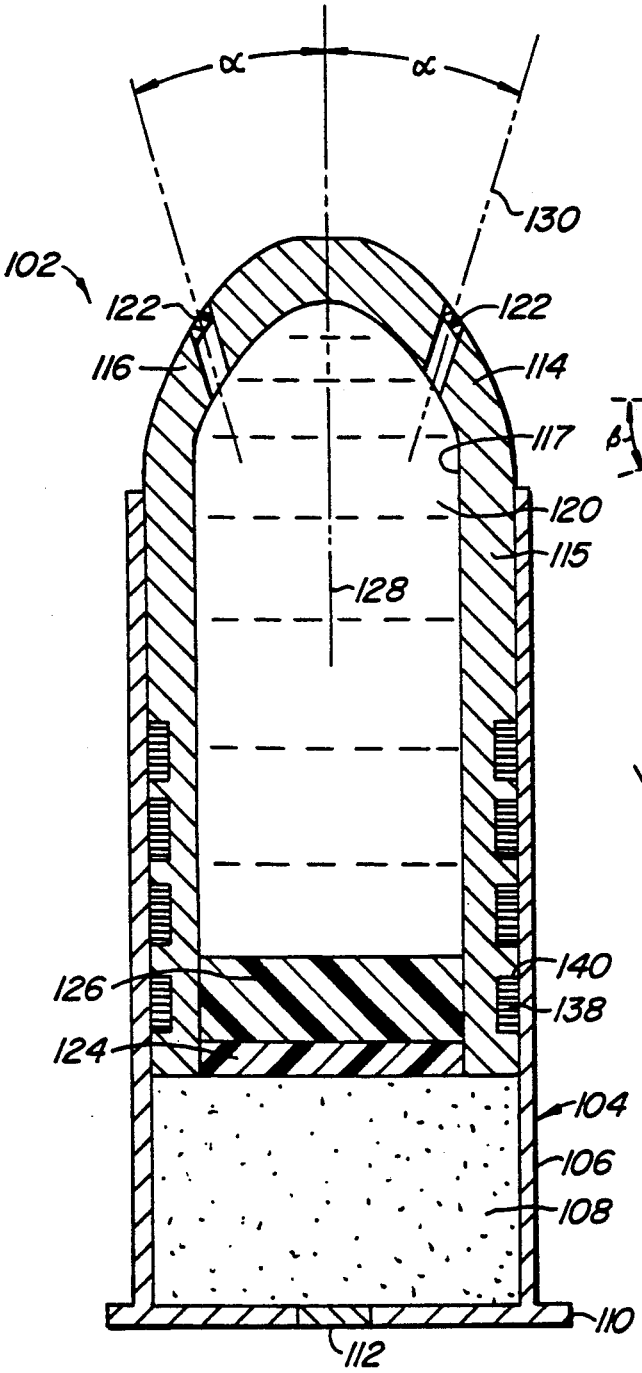
FIG. 5 is a sectional view of the barrel-cleaning bullet of FIGS. 3 and 4 taken along line 5—5 in FIG. 4.
Figure 4:
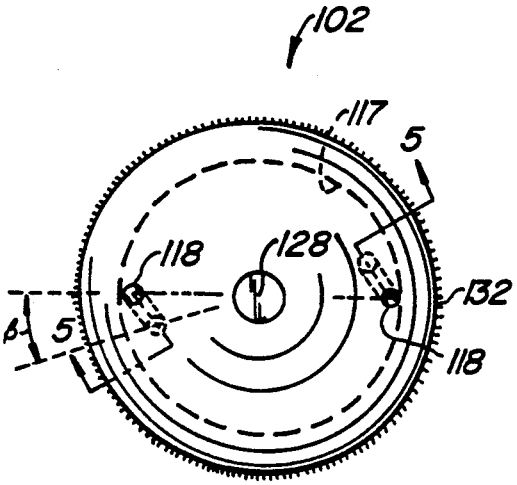
FIG. 4 is a top plan view of the barrel-cleaning bullet of FIG. 3.
Figure 3:
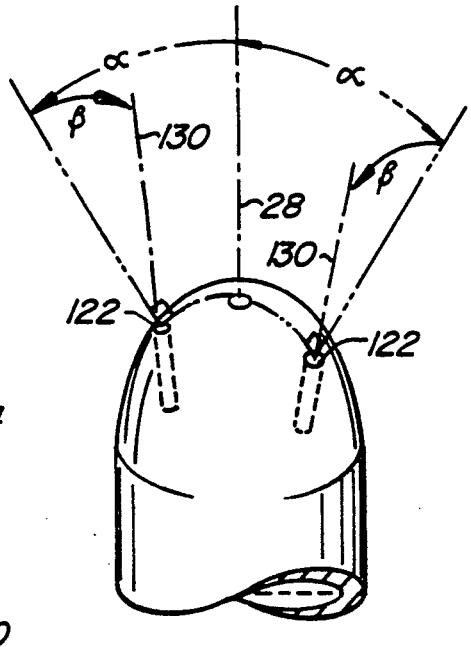
FIG. 3 is a perspective view of the forward end of a barrel-cleaning bullet constructed in accordance with another embodiment of the present invention.

In a further embodiment, multiple discharge ports are formed in the forward end of the bullet as illustrated in FIGS. 3–5. The elements in FIGS. 3–5 correspond to the elements in FIGS. 1 and 2 and are designated with corresponding 100 series numerals to reflect that correspondence. As is evident from the drawings, barrel-cleaning bullet 102 differs from barrel-cleaning bullet 2 in discharge port number and orientation. Since barrel-cleaning bullets 2 and 102 and shells 4 and 104 are the same in all other respects, only the multiple port configuration will be described. Referring to FIGS. 3–5, barrel-cleaning bullet 102 includes two circumferentially equidistantly spaced discharge ports 122. The inlet of each discharge port is radially spaced from the longitudinal axis 128 of the cleaning bullet. The center line of each discharge port is radially offset from the longitudinal axis 128 as designated by angle $\alpha$. The outlet of each discharge port is circumferentially spaced from its corresponding inlet as designated by angle $\beta$ in FIG. 4. $\alpha$ and $\beta$ are preferably about 5 to 15 degrees. This discharge port configuration will cause the fluid dispensed from the projectile to follow a spiral path along the inner wall surfaces of the barrel bore. Barrel wall coverage is increased with the multiport design. Since the ports are circumferentially equidistantly spaced, the reaction forces from the fluid discharge are balanced, thereby minimizing gun barrel vibration. This is especially advantageous in machine gun applications where one cleaning bullet can be placed among others in the bullet chain linkage. Vibration caused by the cleaning bullet, if it were not balanced, for example, would reduce the firing accuracy of the bullets that immediately follow. Although the multiport configuration of cleaning bullet I02 as having two discharge ports, more than two ports can be incorporated without departing from the scope of the present invention.

The above is a detailed description of the invention. It is recognized that departures from the disclosed embodiments may be made within the scope of the invention and that obvious modification will occur to a person skilled in the art. The full scope of the invention is set out in the claims that follow and their equivalents. Accordingly, the claims and specification should not be construed to unduly narrow the full scope of protection to which the invention is entitled.

WHAT IS CLAIMED IS:

1. A barrel-cleaning projectile comprising:

a body portion including a forward and rearward end, said body portion having a cavity formed therein;

cleaning fluid disposed in said cavity;

a piston slidably mounted in said cavity and positioned adjacent to said rearward end, said piston having a forward face facing said cleaning fluid;

at least one discharge port extending from said cavity to the exterior of said body portion and having an outlet opening in the vicinity of said forward end for discharging fluid beyond said forward end; and a cleaning member extending beyond the exterior surface of the body portion between said discharge port and rearward end; whereby firing of the projectile causes the piston to move toward the fluid and force it through the discharge port for distribution in the barrel such that accumulated deposits are treated before coming into contact with the cleaning member.

2. The projectile of claim 1 including multiple equidistantly spaced discharge ports.

3. The projectile of claim 1 wherein said cleaning fluid comprises a mixture of lubricant and solvent.

4. The projectile of claim 1 further including a disc-shaped seal positioned on the side of said piston opposite said fluid charge.

5. The projectile of claim 1 further including means for sealing said discharge port.

6. The projectile of claim 1 wherein the longitudinal axis of said body portion and the center axis of said discharge port are angularly offset from one another about 5 to 15 degrees.

7. The projectile of claim 1 wherein said cleaning member comprises means for scraping said deposits from the barrel.

8. The projectile of claim 7 including another cleaning member comprising means for wiping residue from the barrel.

9. The projectile of claim 8 wherein said scraping means comprises spaced rings of bristles.

10. The projectile of claim 9 wherein said wiping means comprises spaced annular absorbent pads.

11. A barrel-cleaning device comprising:

a shell containing a charge of propellant;

a hollow bullet disposed in said shell, said bullet including a chamber and forward and rearward ends, said rearward end being adjacent to said propellant charge;

a charge of cleaning fluid disposed in said chamber;

a piston slidably mounted in said chamber and positioned adjacent to said rearward end;

at least one discharge port in the vicinity of the forward end of said bullet and extending generally axially from said chamber; and means for scraping deposits from said barrel, said scraping means being coupled to the exterior of the hollow bullet between said forward and rearward ends.

12. The device of claim 11 wherein the center line of each discharge port and rotational axis of said hollow bullet form an angle of about 5 to 15 degrees.

13. The device of claim 11 further including a seal disposed in said chamber between said piston and propellant charge.

14. The device of claim 11 further including a seal that seals said discharge port.

15. The device of claim 11 including multiple discharge ports.

16. The device of claim 15 wherein said discharge ports are substantially equidistantly spaced.

17. The device of claim 11 further including means for wiping residue from said barrel, said wiping means being coupled to the exterior of said hollow bullet between said scraping means and rearward end.

18. The device of claim 17 wherein said wiping means comprises an annular felt pad.

19. A method of cleaning a gun barrel comprising the steps of:

providing a bullet having a charge of cleaning solution and mechanical cleaning elements;

dispensing the cleaning solution along the inner wall surfaces of a gun barrel; and accelerating the bullet down the gun barrel, while cleaning the inner wall surfaces with the mechanical cleaning elements.

20. The method of claim 19 wherein substantially all of the cleaning solution is dispensed before the bullet begins to travel down the barrel.

* * * * *